US007222663B2

(12) United States Patent
Higashiyama

(10) Patent No.: US 7,222,663 B2
(45) Date of Patent: May 29, 2007

(54) EVAPORATOR AND VEHICLE PROVIDED WITH REFRIGERATION CYCLE HAVING THE SAME

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 11/368,686

(22) Filed: Mar. 7, 2006

(65) Prior Publication Data

US 2006/0144577 A1 Jul. 6, 2006

Related U.S. Application Data

(63) Continuation of application No. 10/491,445, filed as application No. PCT/JP02/10772 on Oct. 17, 2002, now Pat. No. 7,040,385.

(60) Provisional application No. 60/330,682, filed on Oct. 29, 2001.

(30) Foreign Application Priority Data

Oct. 17, 2001 (JP) ..... 2001-319842

(51) Int. Cl.
*F28D 1/02* (2006.01)

(52) U.S. Cl. ..... 165/153; 165/176

(58) Field of Classification Search ..... 165/150–153, 165/173–176

See application file for complete search history.

(56) References Cited

U.S. PATENT DOCUMENTS

| | | | | |
|---|---|---|---|---|
| 4,969,512 | A * | 11/1990 | Hisao et al. | 165/153 |
| 5,024,269 | A * | 6/1991 | Noguchi et al. | 165/153 |
| 5,228,315 | A | 7/1993 | Nagasaka et al. | 165/175 |
| 5,662,164 | A * | 9/1997 | Nishishita | 165/153 |
| 5,701,760 | A * | 12/1997 | Torigoe et al. | 62/524 |
| 5,735,343 | A | 4/1998 | Kajikawa et al. | 165/176 |
| 5,778,974 | A * | 7/1998 | Kazikawa et al. | 165/153 |
| 5,901,782 | A | 5/1999 | Voss et al. | 165/176 |
| 5,931,020 | A * | 8/1999 | Nakamura | 165/146 |
| 6,199,401 | B1 | 3/2001 | Haussmann | 165/174 |
| 6,272,881 | B1 | 8/2001 | Kuroyanagi et al. | 62/525 |
| 6,401,804 | B1 * | 6/2002 | Shimoya et al. | 165/70 |
| 2002/0079093 | A1 * | 6/2002 | Rong | 165/153 |
| 2003/0116308 | A1 | 6/2003 | Watanabe et al. | 165/174 |

FOREIGN PATENT DOCUMENTS

| | | |
|---|---|---|
| EP | 1058080 | 12/2000 |
| JP | 9-318195 | 12/1997 |
| JP | 2002-71283 | 3/2002 |

* cited by examiner

*Primary Examiner*—Teresa J. Walberg
(74) *Attorney, Agent, or Firm*—Oblon, Spivak, McClelland, Maier & Neustadt, P.C.

(57) ABSTRACT

An evaporator having front and rear heat exchange assemblies arranged at air inlet and outlet sides, respectively, and adjacent to each other. Each heat exchange assembly includes a pair of upper and lower headers, and multiple refrigerant channels each having upper and lower ends connected to the upper header and lower headers. The upper and lower headers are internally provided with vertical partitions for internally dividing the headers into portions arranged laterally to reverse the direction of upward or rearward flow of a refrigerant through the refrigerant channels of the rear heat exchange assembly every specified number of refrigerant channels, and thereby provide at least one group of upward refrigerant channels in each of left and right halves of the rear heat exchange assembly. The evaporator can be used in a motor vehicle air conditioner.

18 Claims, 13 Drawing Sheets

EVAPORATOR AND VEHICLE PROVIDED WITH REFRIGERATION CYCLE HAVING THE SAME

CROSS REFERENCE TO RELATED APPLICATIONS

This application is a continuation of and claims the benefit of priority from U.S. Ser. No. 10/491,445, filed Apr. 14, 2004 now U.S. Pat. No. 7,040,385, which is a national stage of PCT/JP02/10772, filed Oct. 17, 2002, which is based upon U.S. Ser. No. 60/330,682, filed Oct. 29, 2001, and further is based upon and claims the benefit of priority from the prior Japanese Patent Application No. 2001-319842, filed Oct. 17, 2001, the entire contents of each of which are incorporated herein by reference.

TECHNICAL FIELD

The present invention relates to evaporators and vehicles provided with a refrigeration cycle such as a motor vehicle air conditioner having the evaporator.

The "front" and "rear" of the evaporator are based in the flow of air; the term "front"refers to the side of the evaporator where air enters, and the term "rear" to the side thereof from which the air flows out. The terms "left" and "right" refer respectively to the left and right sides of the evaporator as it is seen from the front rearward.

BACKGROUND ART

In the case of motor vehicle air conditioners, the air cooled by the evaporator is forced out of a plurality of air vents into the interior of the vehicle. Usually for introduction into the interior of the vehicle, the portion of air passing through the left half of the evaporator flows out of the vent at the left (e.g. as opposed to the driver's seat), and the portion of air passing through the right half of the evaporator flows out of the vent at the right (e.g. as opposed to the passenger seat). Accordingly, if there is a temperature difference between the former portion of air and the latter portion of air, the riders are likely to feel discomfort. This problem becomes more pronounced since there is in recent years a tendency for the distance between the evaporator and the air vent to become smaller. The air temperature difference appears markedly with an increase in the lateral dimension of the evaporator.

To enable the left and right halves of the evaporator to provide air of uniform temperature, various refrigerant flow patterns have heretofore been contrived for use in evaporators. FIG. 13 shows an example of pattern. The illustrated evaporator 500 comprises a front heat exchange assembly 500A and a rear heat exchange assembly 500B which are adjacent to each other. Each of the heat exchange assemblies 500A, 500B comprises a pair of upper and lower horizontal headers 502 extending laterally, and a multiplicity of vertical refrigerant channels 503 arranged laterally at a spacing and each having an upper end connected to the upper header 502 and a lower end connected to the lower header 502. A refrigerant inlet 504 is provided at the left end of the upper header 502 of the rear heat exchange assembly 500B, and a refrigerant outlet 505 is provided at the left end of the upper header 502 of the front heat exchange assembly 500A. The upper headers 502 of the front and rear heat exchange assemblies 500A, 500B communicate with each other through communication tube portions 506 at portions thereof toward their right ends. The upper header 502 of the rear heat exchange assembly 500B is internally divided into two left and right portions by a vertical partition 502A so that the refrigerant flows downward through the channels 503 of the left half of the rear heat exchange assembly 500B, with the refrigerant flowing upward through the channels 503 of the right half of the rear heat exchange assembly 500B.

The upper header 502 of the front heat exchange assembly 500A is internally divided into two left and right portions by a vertical partition 502A so that the refrigerant flows downward through the channels 503 of the right half of the front heat exchange assembly 500A, with the refrigerant flowing upward through the channels 503 of he left half of the front heat exchange assembly 500A.

With the evaporator 500 of FIG. 13, the left half of the rear heat exchange assembly 500B wherein the refrigerant temperature is lowest, and the left half of the front heat exchange assembly 500A wherein the refrigerant temperature is highest are adjacent to each other along the direction of flow of air. Further the right half of the rear heat exchange assembly 500B wherein the refrigerant temperature is second lowest, and the right half of the front heat exchange assembly 500A wherein the refrigerant temperature is second highest are adjacent to each other along the direction of flow of air. Consequently, the portions of air A passing through the left and right halves respectively become substantially uniform in temperature.

With the evaporator 500 described, however, the portions of air A passing through the respective left and right halves of the evaporator 500 fail to become uniform in temperature to produce a temperature difference between the air portions forced out of the left and right vents respectively, when the clutch mechanism of the compressor is automatically disengaged, namely, when the flow of refrigerant through the evaporator 500 is temporarily halted, in order to prevent overcooling of air.

An object of the present invention is to provide an evaporator, for example, for use in motor vehicle air conditioners which provides air of uniform temperature as passed through the left and right halves thereof even when the clutch mechanism of the compressor is disengaged and which is therefore free of the likelihood of giving discomfort to the riders.

DISCLOSURE OF THE INVENTION

When the clutch mechanism of the compressor is coupled to the crankshaft of the engine while a motor vehicle air conditioner is in operation, it is thought that the refrigerant flows through the refrigerant channels of the evaporator, as uniformly vaporized depending on the extent of evaporation of the refrigerant in the channels. When the clutch mechanism of the compressor is disengaged, on the other hand, the supply of refrigerant to the evaporator is temporarily interrupted, and the refrigerant remaining in the evaporator appears to exhibit the following behavior. The portion of refrigerant remaining in the group of downward refrigerant channels tends to flow into the subsequent group of upward refrigerant channels, partly under the action of gravity. On the other hand, the portion of refrigerant remaining in the group of upward refrigerant channels is returned even if acting to flow upward against the gravity and is therefore liable to stagnate in this group of channels. For this reason, it is thought that a larger amount of refrigerant is stagnant in the upward refrigerant channel group than in the downward refrigerant channel group.

Accordingly, the present inventor has found that the following refrigerant flow patterns are useful for evaporators to fulfill the foregoing object.

Thus, the present invention provides an evaporator having a front heat exchange assembly and a rear heat exchange assembly arranged at an air inlet side and an air outlet side, respectively, and adjacent to each other, each of the heat exchange assemblies comprising a pair of upper and lower headers extending laterally, and a multiplicity of refrigerant channels arranged laterally at a spacing and each having an upper end connected to the upper header and a lower end connected to the lower header, a refrigerant inlet being provided at one end of the upper or lower header of the rear heat exchange assembly, a refrigerant outlet being provided at one end of the upper or lower header of the front heat exchange assembly, the upper or lower header of the rear heat exchange assembly communicating at a portion thereof toward the other end with the upper or lower header of the front heat exchange assembly at a portion thereof toward the other end by communication means, the upper and lower headers of the rear heat exchange assembly being internally provided with vertical partitions for internally dividing the headers into portions arranged laterally so as to reverse the direction of upward or rearward flow of a refrigerant through the refrigerant channels of the rear heat exchange assembly for every specified number of refrigerant channels and thereby provide at least one group of upward refrigerant channels in each of a left half and a right half of the rear heat exchange assembly.

While the clutch mechanism of the compressor is disengaged, a relatively large amount of refrigerant is stagnant in the group of upward refrigerant channels in each of the left and right halves of the rear heat exchange assembly of the evaporator described, so that the portions of air passing through the respective left and right halves of the evaporator are maintained at an approximately uniform temperature.

With the evaporator of the invention, it is desired that the refrigerant channels of the rear heat exchange assembly adjacent to the refrigerant channels of the front heat exchange assembly wherein the refrigerant is in an superheated state be included in the group of upward refrigerant channels.

The refrigerant channels of the front heat exchange assembly wherein the refrigerant is in an superheated state have a relatively high temperature of course when the compressor clutch mechanism is engaged and also when the clutch mechanism is disengaged, whereas if at least some of the upward refrigerant channels of the rear heat exchange assembly wherein the refrigerant portion of relatively low temperature is stagnant are arranged adjacent to the above front assembly channels, the air passing through the left and right halves of the evaporator can be maintained at a more uniform temperature.

With the evaporator of the invention, the refrigerant to be caused to flow into the group of upward refrigerant channels of the rear heat exchange assembly which are positioned remotest from the refrigerant inlet may be made to dividedly flow into and flow upward through a plurality of refrigerant channels of the front heat exchange assembly which are adjacent to the plurality of refrigerant channels of the rear heat exchange assembly constituting the group, by causing the lower headers of the front and rear heat exchange assemblies to communicate with each other by flow-dividing communication means at the header portions corresponding to the plurality of refrigerant channels.

Similarly the evaporator may be so adapted that the refrigerant to be caused to flow into the group of downward refrigerant channels of the rear heat exchange assembly which are positioned remotest from the refrigerant inlet is made to dividedly flow into and downward through a plurality of refrigerant channels of the front heat exchange assembly which are adjacent to the plurality of refrigerant channels of the rear heat exchange assembly constituting the group, by causing the upper headers of the front and rear heat exchange assemblies to communicate with each other through flow-dividing communication means at the header portions corresponding to the plurality of refrigerant channels.

When the refrigerant to be caused to flow into the group of upward or downward refrigerant channels of the rear heat exchange assembly which are positioned remotest from the refrigerant inlet is caused by flow-dividing communication means to dividedly flow into a plurality of refrigerant channels of the front heat exchange assembly which are adjacent to rear assembly channels of the group, the pressure loss of the refrigerant can be diminished.

The rear assembly channels of upward or downward refrigerant channel group positioned remotest from the refrigerant inlet can be made independent of the front assembly channels adjacent to the rear assembly channels. Alternatively, the former channels may each be united with the corresponding one of the latter channels. In the latter case, the refrigerant can be caused to flow from the rear heat exchange assembly to the turn portion of the front assembly substantially over the entire width of the evaporator, whereby the pressure loss of the refrigerant can further be reduced.

With the evaporator of the invention, the refrigerant inlet is provided at one end of the lower header of the rear heat exchange assembly, and the rear heat exchange assembly has the group of upward refrigerant channels as each of the first and the third groups as counted from the refrigerant inlet side, and a group of downward refrigerant channels as each of the second and fourth groups as counted from the inlet side.

In this case, at least some of the upward refrigerant channels in the first group of the rear heat exchange assembly are usually arranged adjacent to the front assembly refrigerant channels wherein the refrigerant is in the superheated state. Further in this case, it is usually desirable to use at least seventeen refrigerant channels for each of the front and rear assemblies from the viewpoint of reducing the pressure loss of the refrigerant.

The evaporator of the invention may be so designed that the refrigerant inlet is provided at one end of the upper header of the rear heat exchange assembly, and that the rear heat exchange assembly has the group of upward refrigerant channels as each of the second and the fourth groups as counted from the refrigerant inlet side, and a group of downward refrigerant channels as each of the first and third groups as counted from the inlet side.

In this case, at least some of the upward refrigerant channels in the second group of the rear heat exchange assembly are usually arranged adjacent to the front assembly refrigerant channels wherein the refrigerant is in the superheated state. Further in this case, it is also usually desirable to use at least seventeen refrigerant channels for each of the front and rear assemblies from the viewpoint of reducing the pressure loss of the refrigerant.

With the evaporator of the invention, the refrigerant inlet may be provided at one end of the lower header of the rear heat exchange assembly, and the rear heat exchange assembly may have the group of upward refrigerant channels as each of the first and the third groups as counted from the refrigerant inlet side, and a group of downward refrigerant channels as the second group as counted from the inlet side.

In this case, at least some of the upward refrigerant channels in the first group of the rear heat exchange assembly are usually arranged adjacent to the front assembly refrigerant channels wherein the refrigerant is in the superheated state. Further in this case, it is usually desirable to use at least thirteen refrigerant channels for each of the front and rear assemblies from the viewpoint of reducing the pressure loss of the refrigerant.

With the evaporator of the invention, the rear heat exchange assembly has the group of upward refrigerant channels and a group of downward refrigerant channels each comprising four to eight refrigerant channels.

When the number of refrigerant channels of each channel group of the rear heat exchange assembly is less than four, an excessively great refrigerant pressure loss will result, possibly causing trouble to the flow of refrigerant. If the number of refrigerant channels of each rear assembly channel group is in excess of eight, on the other hand, the evaporator will have too great a lateral width, presenting difficulty in incorporating the evaporator into a cooling unit.

The upper and lower headers and the refrigerant channels of the front and rear heat exchange assemblies of the evaporator of the invention may be formed by a multiplicity of pairs of plates, each of the plates being provided in each of a front and a rear portion of one surface thereof with a pair of upper and lower header recesses and a channel recess communicating at upper and lower ends thereof with the header recesses, each pair of plates being joined to each other with the recessed surfaces thereof opposed to each other, the pairs of plates being fitted into juxtaposed layers with bottom walls of the corresponding recesses joined to one another, a refrigerant passing hole being formed in the bottom wall of the header recess disposed at each position where the refrigerant is to be passed, the partitions being provided by the respective bottom walls of upper and lower header recesses having no refrigerant passing hole.

With evaporator of the invention, the upper and lower headers of the front and rear heat exchange assemblies may be provided by front and rear two tank chambers in a pair of upper and lower tanks, and the refrigerant channels of the front and rear heat exchange assemblies may be provided by front and rear two rows of many refrigerant tubes connected at upper and lower ends thereof to the respective front and rear tank chambers of the upper and lower tanks, the partitions being formed by respective walls so provided as to divide the rear tank chambers of upper and lower tanks into portions arranged laterally.

The present invention includes a vehicle provided with a refrigeration cycle having a compressor, a condenser and an evaporator, the evaporator being the evaporator of the invention described above.

Even when the clutch mechanism of the compressor of the refrigeration cycle of a motor vehicle air conditioner or the like is disengaged, the air passing through the left and right halves of the evaporator is maintained at a uniform temperature, enabling the air vents of the vehicle to force out air of uniform temperature into the interior thereof without the likelihood of causing discomfort to the riders.

BEST MODE OF CARRYING OUT THE INVENTION

Figure 1:
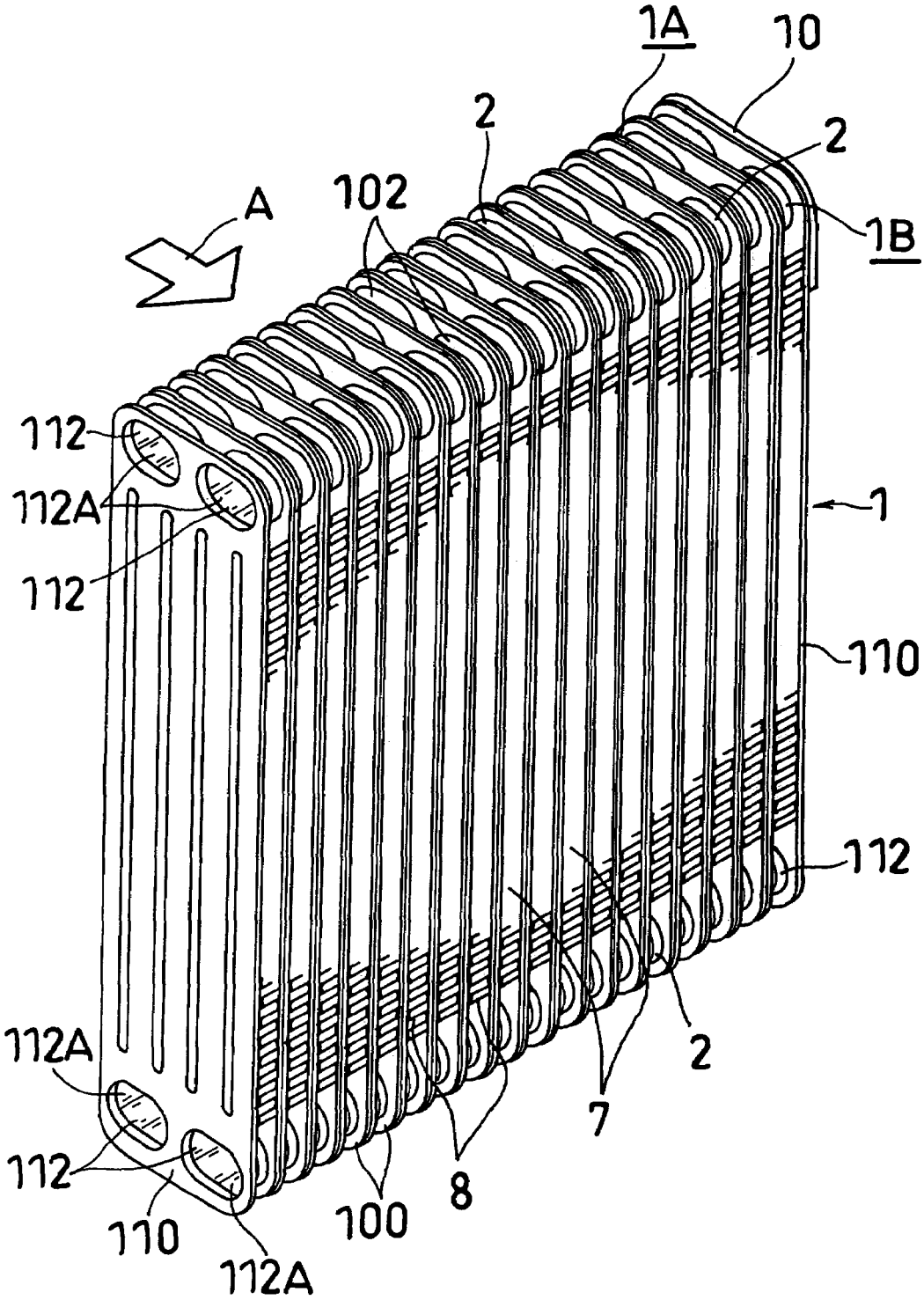
FIG. 1 is an overall perspective view showing a first embodiment of the invention, i.e., an evaporator for motor vehicle air conditioners.
Figure 2:
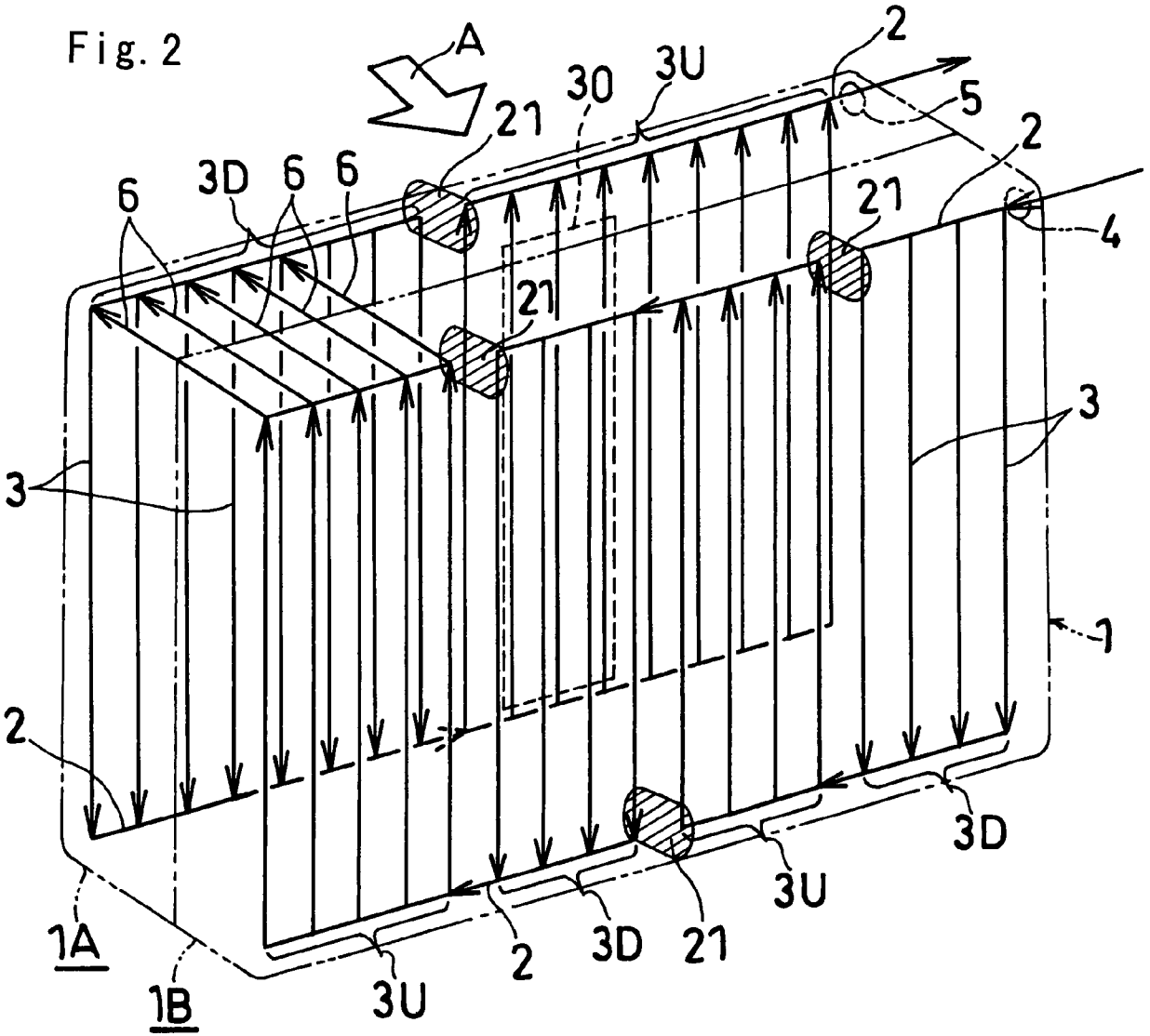
FIG. 2 is a diagram showing the flow of refrigerant through the evaporator of FIG. 1.

FIGS. 1 to 6 show a first embodiment of the invention. With reference to FIGS. 1 and 2, an evaporator 1 according to the invention for use in motor vehicle air conditioners has a front heat exchange assembly 1A and a rear heat exchange assembly 1B which are arranged at an air inlet side and an air outlet side, respectively, and adjacent to each other. Each of the heat exchange assemblies 1A, 1B comprises a pair of upper and lower headers 2 extending laterally, and seventeen vertical refrigerant channels 3 arranged laterally at a spacing and each having an upper end connected to the upper header 2 and a lower end connected to the lower header 2. A refrigerant inlet 4 is provided at the left end of the upper header 2 of the rear heat exchange assembly 1B, and a refrigerant outlet 5 is provided at the left end of the upper header 2 of the front heat exchange assembly 1A. The upper headers 2 of the front and rear heat exchange assemblies 1A, 1B communicate with each other at portions thereof toward the respective right ends through communication tube portions 6 (communication means).

The upper and lower headers 2 of the rear heat exchange assembly 1B are internally provided with vertical partitions 21 for internally dividing the headers 2 into portions in the lateral direction so as to reverse the direction of upward or rearward flow of the refrigerant through the refrigerant channels of the rear heat exchange assembly 1B for every four refrigerant channels and thereby provide a group of upward refrigerant channels 3U in each of the left half and right half of the rear heat exchange assembly 1B. Thus, the rear heat exchange assembly 1B has the upward refrigerant channel group 3U as each of the second and fourth groups as counted from the refrigerant inlet side 4, and a downward refrigerant channel group 3D as each of the first and third groups as counted from the inlet side 4. The upward refrigerant channel group 3U comprises four or five refrigerant channels 3, and the downward refrigerant channel group 3D comprises four refrigerant channels 3.

Further the upper header 2 of the front heat exchange assembly 1A is internally provided with a vertical partition 21 for internally dividing the header 2 into left and right two portions so that the refrigerant flows downward through the eight refrigerant channels 3 on the right side of the assembly 1A and flows upward through the remaining nine refrigerant channels 3.

As shown in FIG. 1, each pair of the refrigerant channels 3, adjacent to each other in the lateral direction, of each of the front and rear heat exchange assemblies 1A, 1B have therebetween a space serving as an air passageway 7, which has an outer fin 8.

As shown in FIGS. 1 and 3 to 6, the upper and lower headers 2 and the refrigerant channels 3 of the front and rear heat exchange assemblies 1A, 1B are formed by a multiplicity of pairs of plates 100. Each of the plates 100 is provided, in each of a front and a rear portion of one surface thereof, with a pair of upper and lower header recesses 102 and a channel recess 103 communicating at upper and lower ends thereof with the header recesses 102. Each pair of plates 100 are joined to each other with the recessed surfaces having the recesses 102, 103 thereof opposed to each other. The pairs of plates 100 are fitted into juxtaposed layers with bottom walls 102A of the recesses 102 joined to one another. A refrigerant passing hole 104 is formed in the bottom wall 102A of the header recess 102 disposed at each position where the refrigerant is to be passed. The partitions 21 in the upper and lower headers 2 of the rear heat exchange assembly 1B are provided by the respective bottom walls 102A of upper and lower header recesses 102 having no refrigerant passing hole. The partition 21 in the upper header 2 of the front heat exchange assembly 1A is provided by the bottom wall 102A of upper header recess 102 having no refrigerant passing hole. The plate 100 is prepared usually from an aluminum or aluminum alloy plate clad with a brazing material over opposite surfaces thereof. The pair of plates 100 are joined to each other usually by brazing. The outer fin 8 is interposed between each pair of adjacent plates 100 at an intermediate portion of their length and joined to the outer surfaces of the two plates 100. An end plate 110 is joined to the outer side of each of the plates 100 positioned at left and right ends, with the outer fin 8 interposed therebetween. Usually the end plate 110 is prepared also from an aluminum or aluminum alloy plate clad with a brazing material over one or each of opposite surfaces thereof, and is joined to the outer surface of the plate 100 at the end by brazing.

Figure 3:
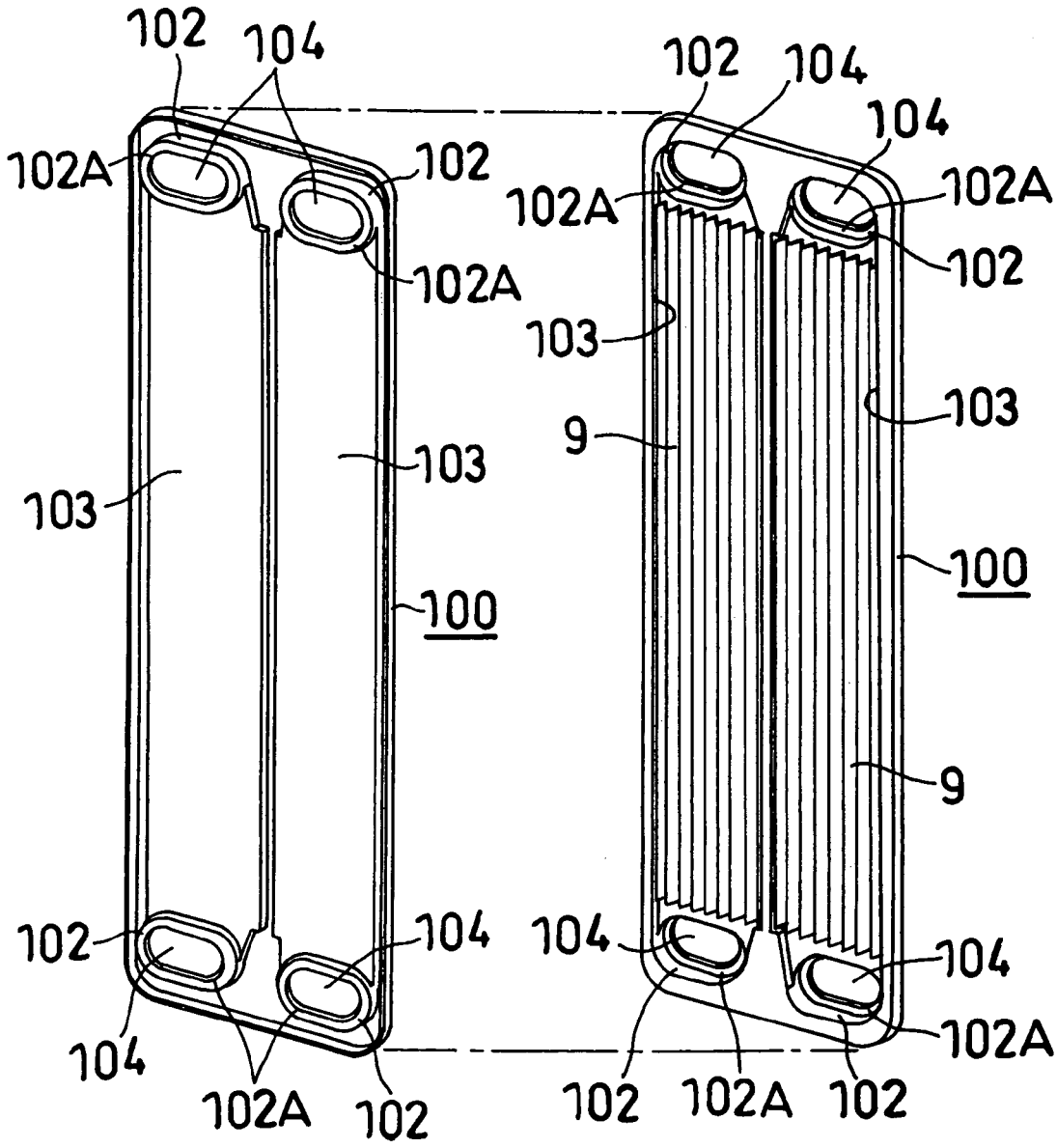
FIG. 3 is a perspective view of a pair of common plates among the components of the evaporator of FIG. 1.

FIG. 3 shows a pair of common plates 100. These plates 100 each have a refrigerant passing hole 104 in the bottom wall 102A of each of upper and lower header recesses 102 in each of the front and rear portions of the plate. A corrugated inner fin 9 is provided in each of front and rear two refrigerant channels 3 formed by front and rear channel recesses 103 of the two plates 100. The inner fin 9 is made usually from a corrugated sheet of aluminum or aluminum alloy and joined to the inner surfaces of the two plates 100 by brazing.

Figure 4:
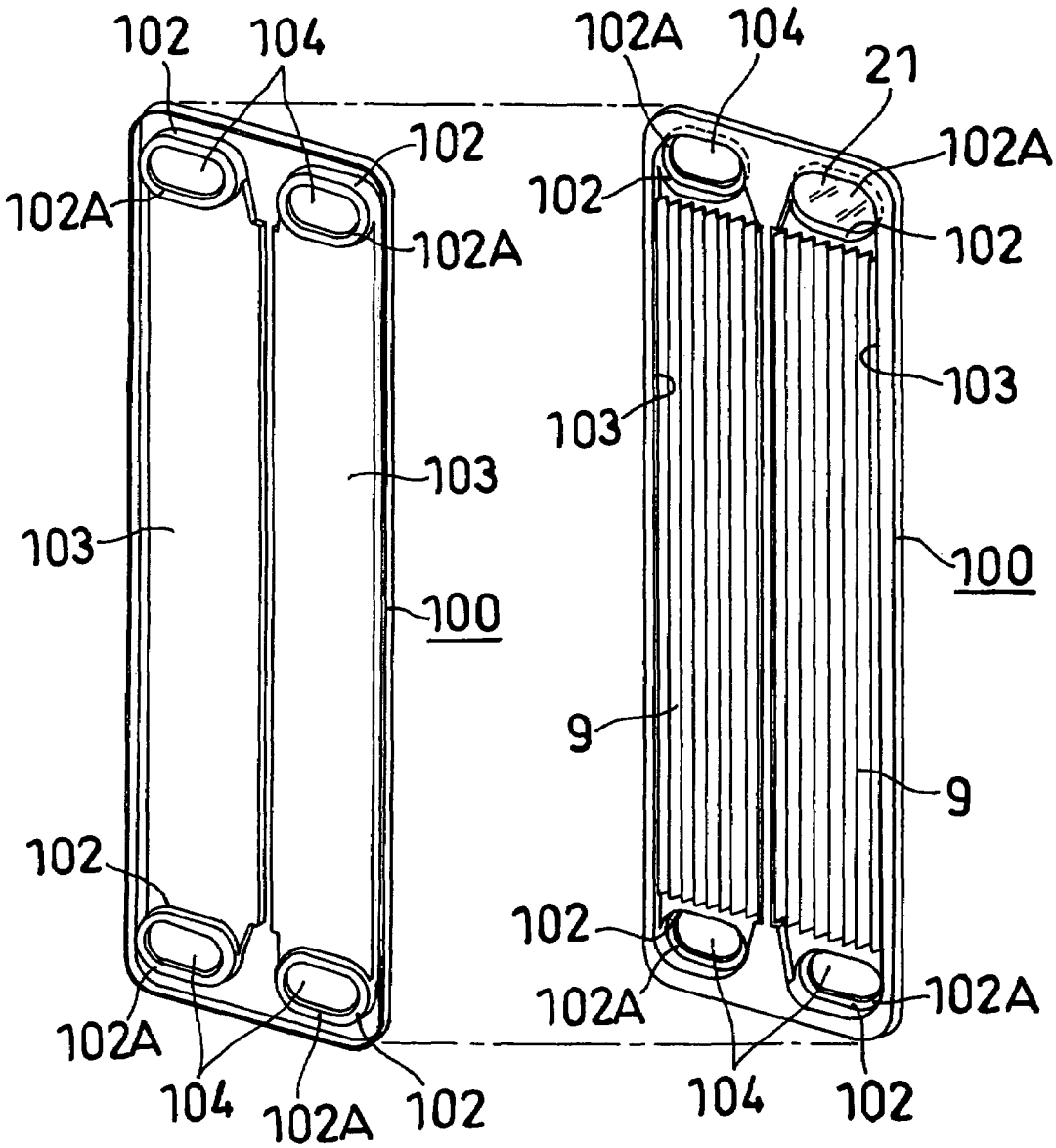
FIG. 4 is a perspective view showing a pair of plates which are included among the components of the evaporator of FIG. 1 and arranged at a position corresponding to a vertical partition in a header.

FIG. 4 shows a pair of plates 100 to be disposed at a position corresponding to the vertical partition 21 of the header 2. With reference to FIG. 4, of the four header recesses 102 of one of the plates 100, the upper header recess 102 on the rear side has no refrigerant passing hole in the bottom wall 102A thereof, and this bottom wall 102A provides the vertical partition 21 in the upper header 2 of the rear heat exchange assembly 1B. The other vertical partitions 21 are formed in the same manner as described above.

Figure 5:
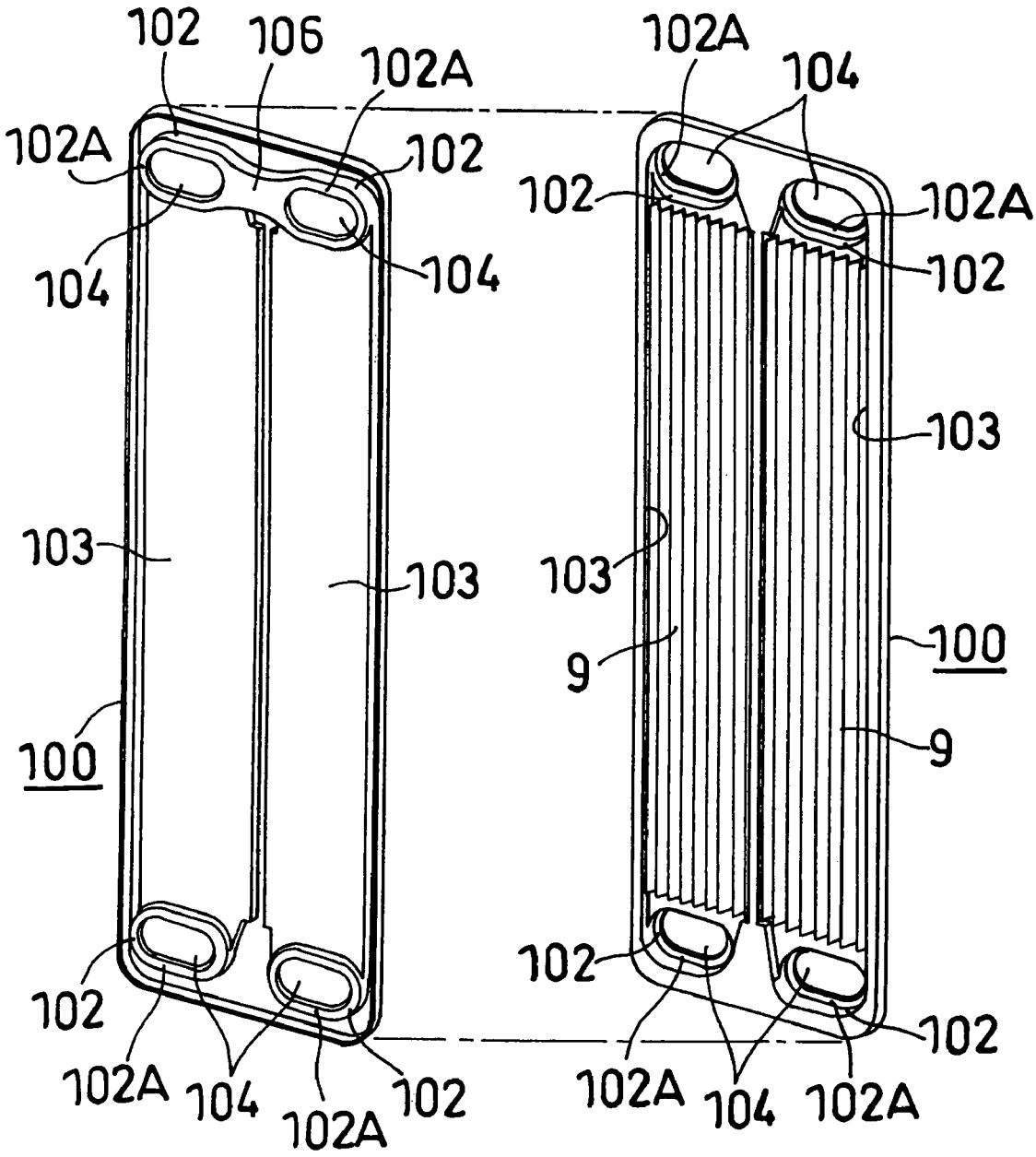
FIG. 5 is a perspective view showing a pair of plates which are included among the components of the evaporator of FIG. 1 and arranged at a position corresponding to a communication tube portion.

FIG. 5 shows a pair of plates 100 to be disposed at a position corresponding to the communication tube portion 6. With reference to FIG. 5, one of the plates 100 is provided in the inner surface thereof with a tube recess 106 extending from front to rear to cause the front and rear two upper header recesses 102 to communicate with each other. The tube recess 106 of this plate 100 and an inner surface portion of the other plate 100 opposed thereto form the communication tube portion 6. Incidentally, the other plate 100 may also have the same tube recess as above to provide a communication tube portion by the tube recesses of the two plates 100.

According to the present embodiment, the communication tube portions 6 which are five in total number are provided in corresponding relation to the five refrigerant channels 3 of the upward refrigerant channel group 3U at the right of the rear heat exchange assembly 1B, whereas a reduced number of tube portions 6 may be used insofar as the resulting refrigerant pressure loss poses no problem. Further the communication tube portions 6 each provided by the recess 106 in the pair of plates 100 serve to hold the upper headers 2 of the front and rear heat exchange assemblies 1A, 1B in communication with each other in the case of the present embodiment. However, alternatively usable is a communication tube portion formed in an end plate for causing the right ends of the upper headers 2 to communicate with each other. The end plate having such a tube portion can be formed by preparing a pair of plates each provided in one surface thereof with a tube recess extending forward or rearward at an upper end portion thereof and joining the plates with the recesses facing toward each other. Further according to the present embodiment, the upper headers 2 of the front and rear heat exchange assemblies 1A. 1B are held in communication with each other by the tube portions 6 at the header portions toward the right ends thereof. Depending on the refrigerant flow pattern, however, there arises a need to provide communication means for holding the upper header 2 of the rear assembly 1B and the lower header 2 of the front assembly 1A in communication with each other at their right ends, or for causing the lower header 2 of the rear assembly 1B to communicate with the upper header 2 of the front assembly 1A at their right ends. Usable in such a case is an end plate which has a communication tube portion extending obliquely therein to hold the header right ends in communication with each other. The end plate can be formed by preparing a pair of plates each provided in one surface thereof with an obliquely extending tube recess and joining the plates with the recesses facing toward each other.

Figure 6:
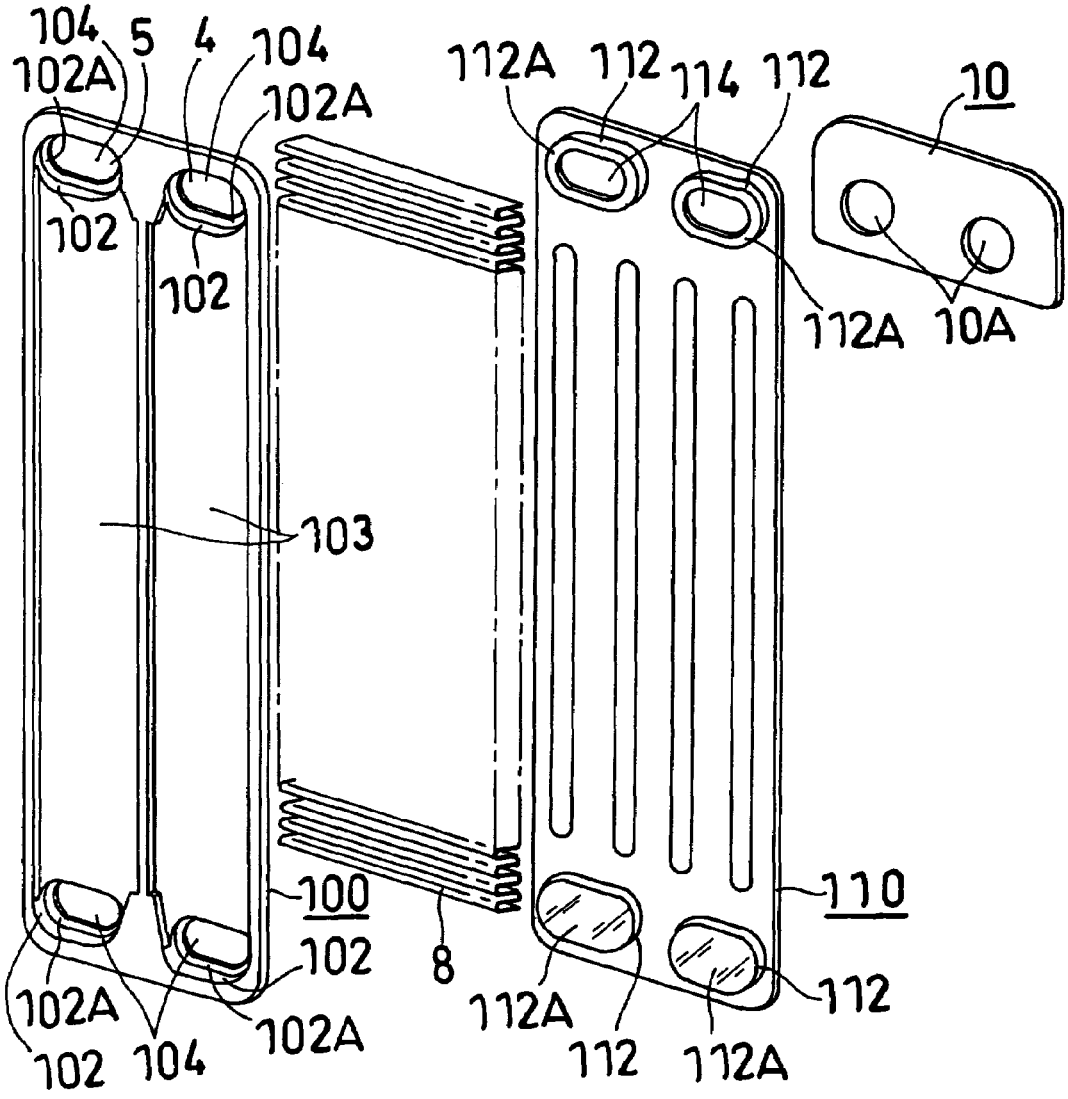
FIG. 6 is a perspective view showing an outer plate at the evaporator left end, left end plate, outer fin and refrigerant pipe connector attaching plate which are included among the components of the evaporator of FIG. 1.

FIG. 6 shows an outer plate 100 at the evaporator left end, left end plate 110, outer fin 8 and refrigerant pipe connector attaching plate 10. With reference to FIG. 6, the plate 100 is the same as the plate 100 shown in FIG. 3. The bottom wall 102A of the rear upper header recess 102 has a refrigerant passing hole 104 serving as the refrigerant inlet 4, and the bottom wall 102A of the front upper header recess 102 has a refrigerant passing hole 104 serving as the refrigerant outlet 5. The end plate 110 is provided in its outer surface with recesses 112 similar to and corresponding to the four header recesses 102 of the plate 100. The upper front and rear two recesses 112 of the end plate 110 have respective bottom walls 112A, in which holes 114 are formed so as to be in register with the refrigerant inlet 4 and the refrigerant outlet 5. On the other hand, the bottom walls 112A of the lower front and rear two recesses 112 of the end plate 110 have no hole to serve as the left end walls of the lower headers 2 of the front and rear heat exchange assemblies 1A, 1B. The outer fin 8 is prepared usually from a corrugated sheet of aluminum or aluminum alloy and joined to the opposed surfaces of the plate 100 and the end plate 110 by brazing. The refrigerant pipe connector attaching plate 10 is made usually from an aluminum or aluminum alloy plate and joined to the upper end portion of the end plate 110 by brazing. The plate 10 has front and rear two holes 10A communicating with the respective holes 114 in the front and rear two recess bottom walls 112A of the end plate 110 and is provided on the outer surface thereof with an unillustrated refrigerant pipe connector joined thereto as by welding. An outer plate 100 at the evaporator right end, right end plate 110, and outer fin 8 to be interposed between these plates are substantially the same as the plate 100, end plate 110 and outer fin 8 shown in FIG. 6, respectively.

In the case where the switch for the motor vehicle air conditioner is closed, with the clutch mechanism of the compressor is coupled to the crankshaft of the engine, the refrigerant flows through the evaporator 1 as shown in FIG. 2. Stated more specifically, the refrigerant introduced into the evaporator 1 via the inlet 4 flows through the rear heat exchange assembly 1B via the upper and lower headers 2 of the assembly 1B, i.e., through the downward refrigerant channel group 3D at the left, the upward refrigerant channel group 3U at the left, the downward refrigerant channel group 3D at the right, and the upward refrigerant channel group 3U at the right in this order, then flows through the communication tube portions 6 to the front heat exchange assembly 1A, thereafter flows through the downward refrigerant channel group 3D at the right of the front assembly 1A and the upward refrigerant channel group 3U at the left thereof via the upper and lower headers 2 of the assembly 1A, and is discharged from the outlet 5. In this flow pattern, the refrigerant flowing through the refrigerant channel group has a lower temperature when the group is in the rear assembly 1B and closer to the refrigerant inlet 4 and a higher temperature when the group is in the front assembly 1A and closer to the refrigerant outlet 5, with the result that the portions of air A passing through the left and right halves of the evaporator 1 are generally uniform in temperature. With the present embodiment, the portions wherein the refrigerant is in a superheated, i.e., so-called superheated portions 30, are usually several refrigerant channels 3 positioned at the right and included the nine refrigerant channels 3 of the upward refrigerant channel group 3U at the left side of the front heat exchange assembly 1A. The rear heat exchange assembly 1B has an upward refrigerant channel group 3U positioned at the left side thereof in corresponding relation with these superheated portions 30.

Figure 13:
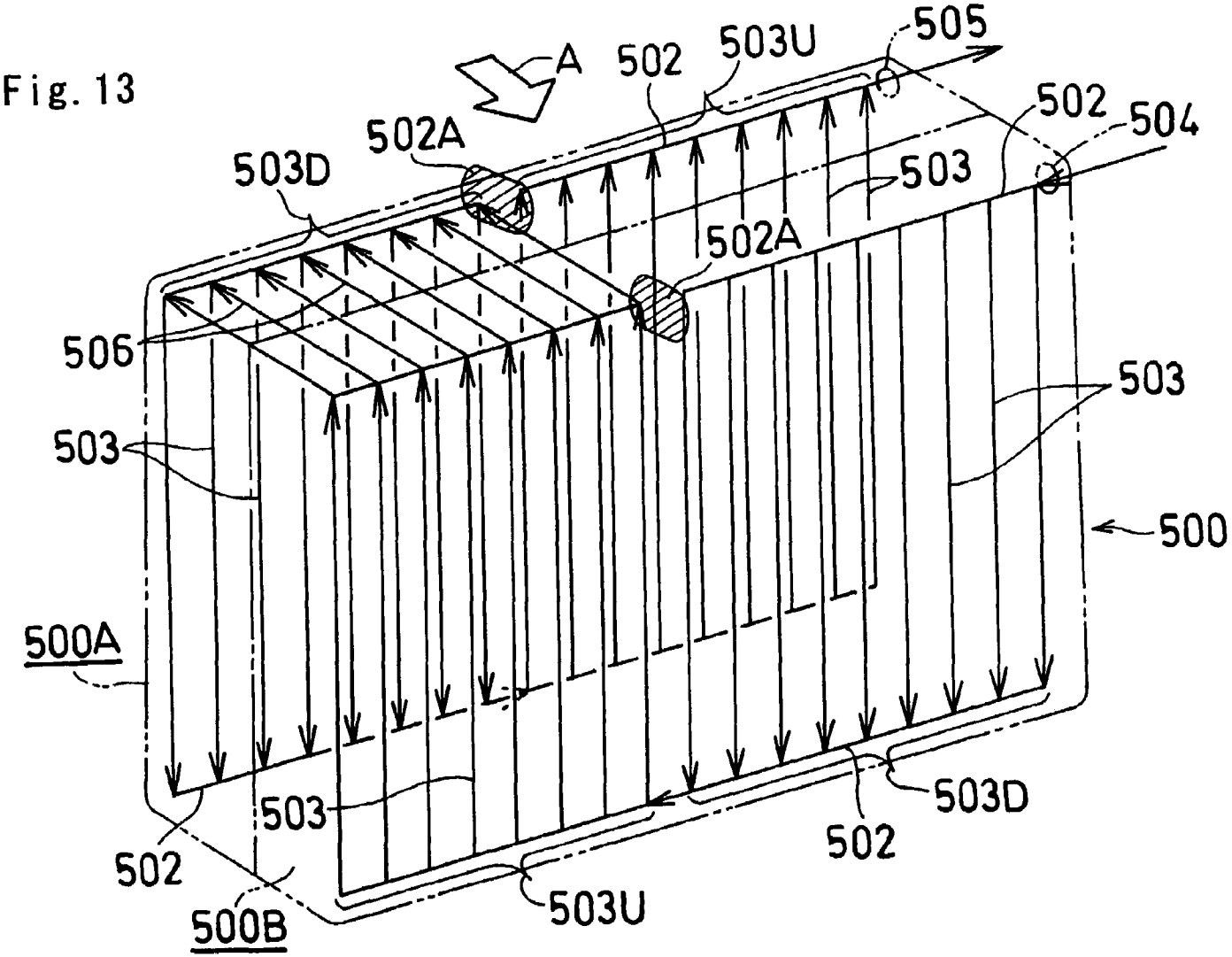
FIG. 13 is a diagram showing the flow of refrigerant through a conventional evaporator.

On the other hand, when the clutch mechanism of the compressor is automatically disengaged to prevent overcooling of air, with the switch for the motor vehicle air conditioner closed, air A is continued to pass through the evaporator 1, but the supply of the refrigerant to the evaporator 1 is temporarily interrupted. In the case where the flow of refrigerant through the conventional evaporator 500 shown in FIG. 13 is thus halted, a portion of refrigerant having a relatively low temperature stagnates in a large amount in the upward refrigerant channel group 503U arranged in the right half of the rear heat exchange assembly 500B of the evaporator 500, while the refrigerant does not stagnates in such a large amount in the downward refrigerant channel group 503D in the left half of the assembly, consequently producing a temperature difference between the air portions passing through the respective left and right halves of the evaporator 500. In the case of the evaporator 1 shown in FIG. 2, the refrigerant stagnates in large amounts in the upward refrigerant channel groups 3U at the respective left and right sides of the rear heat exchange assembly 1B, such that almost no temperature difference occurs between the left half and the right half of the rear assembly 1B. Moreover, the upward refrigerant channel group 3U at the left side of the assembly 1B is juxtaposed with the superheated portions 30 of the front assembly 1A across the direction of flow of air. As a result, the portions of air passing through the left and right halves respectively become substantially uniform in temperature.

Figure 7:
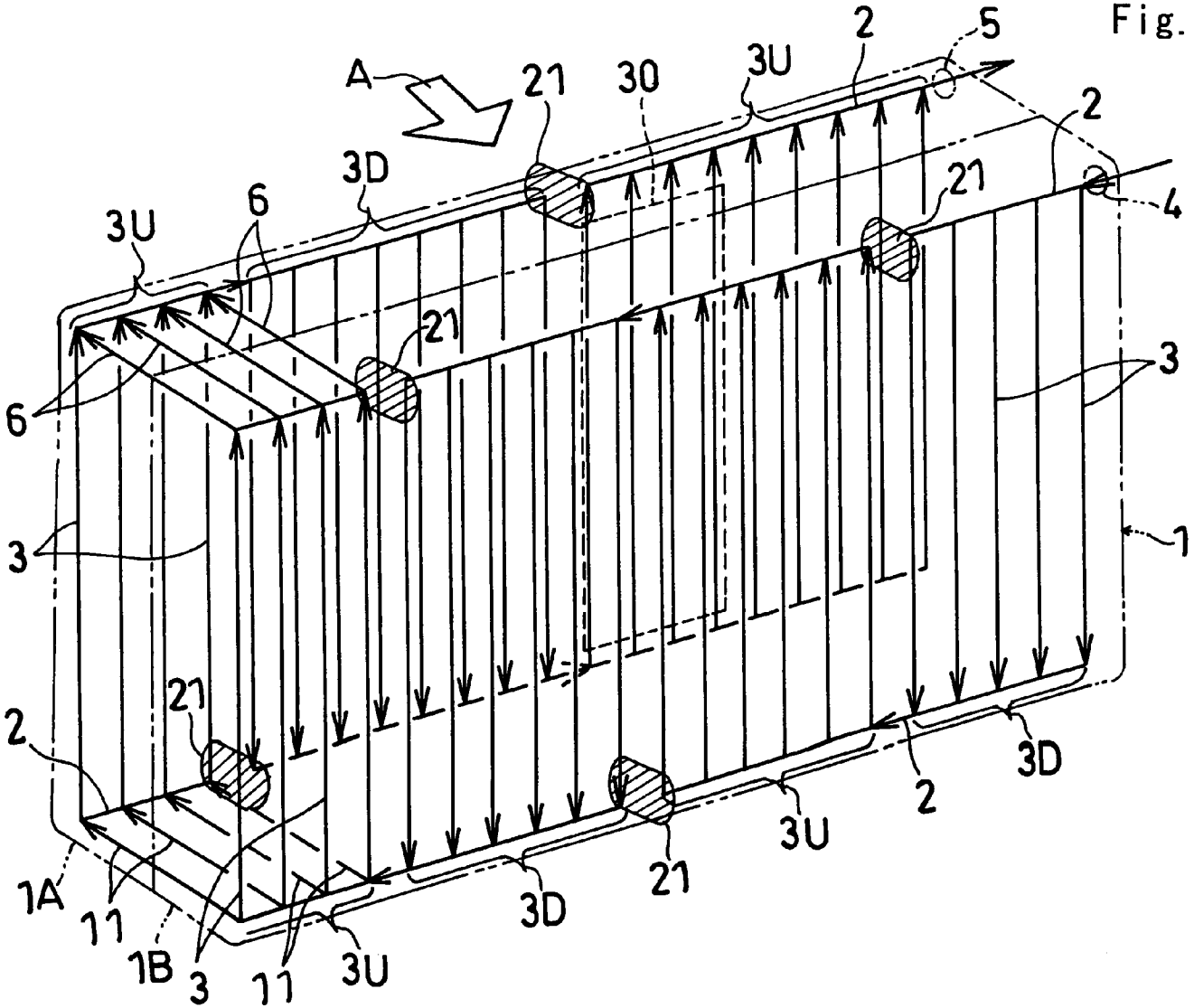
FIG. 7 is a diagram of a second embodiment of the invention to show the flow of refrigerant through the evaporator.
Figure 8:
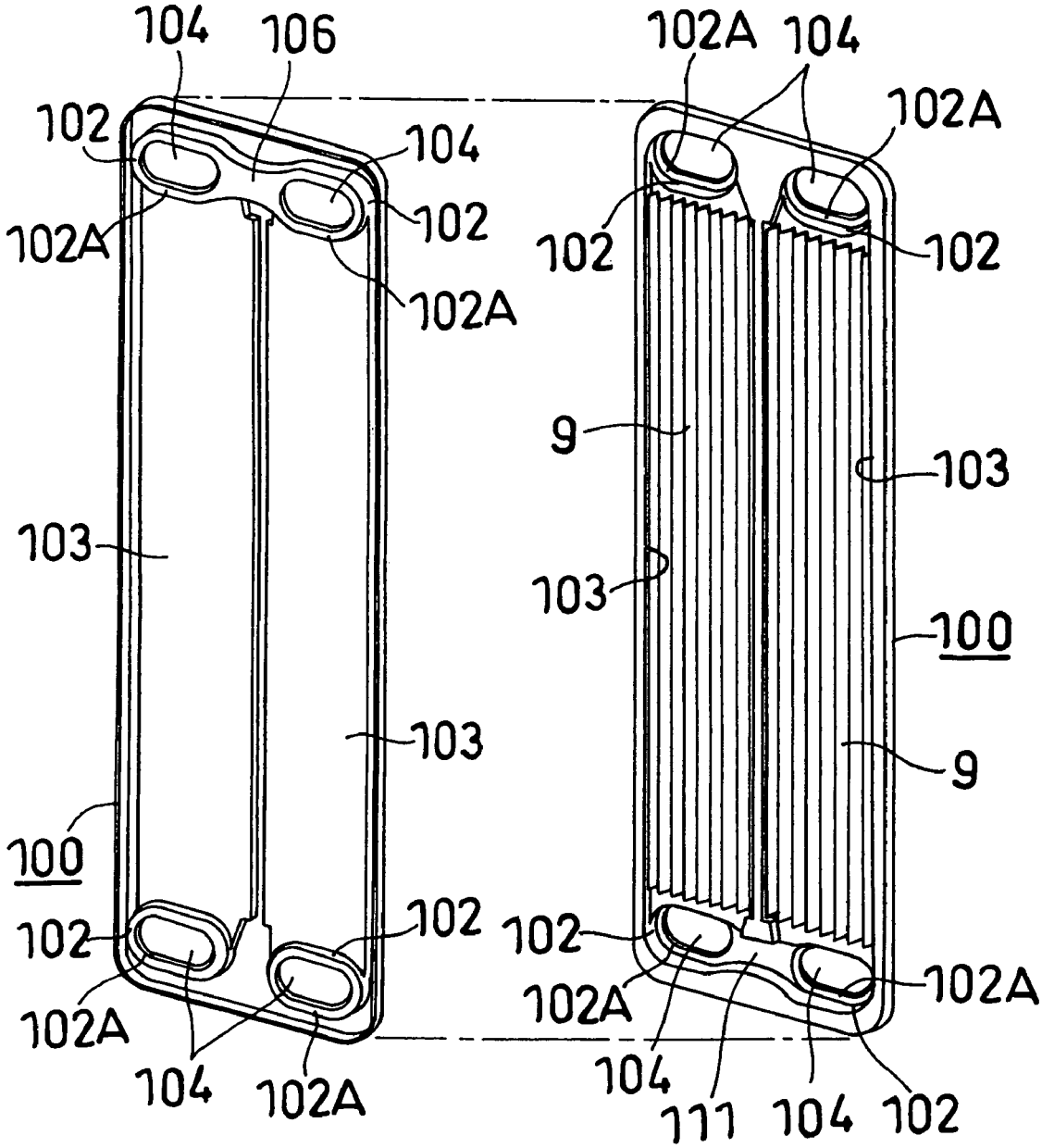
FIG. 8 is a perspective view showing a pair of plates which are included among the components of the evaporator according to the second embodiment and arranged at a position corresponding to a communication tube portion and flow-dividing communication tube portion.

FIGS. 7 and 8 show a second embodiment of the invention. This embodiment is the same as the first embodiment with the exception of the following. First as shown in FIG. 7, front and rear heat exchange assemblies 1A, 1B each have twenty-one vertical refrigerant channels 3. The rear heat exchange assembly 1B has a downward refrigerant channel group 3D at the left, upward refrigerant channel group 3U at the left, downward refrigerant channel group 3D at the right and upward refrigerant channel group 3U at the right which comprise five, six, six and four refrigerant channels 3, respectively.

The refrigerant to be caused to flow into the group of upward refrigerant channel group 3U in the right side of the rear heat exchange assembly 1B is made to dividedly flow into and flow upward through four refrigerant channels 3 of the front heat exchange assembly 1A which are adjacent to the four refrigerant channels 3 of the rear heat exchange assembly 1B constituting the group 3U, by causing the lower headers 2 of the front and rear heat exchange assemblies 1A, 1B to communicate with each other by flow-dividing communication tube portions 11 (flow-dividing communication means) at the header portions corresponding to the plurality of refrigerant channels 3. This reduces the pressure loss of the refrigerant.

The upper and lower headers 2 of the front heat exchange assembly 1A are each internally divided into left and right two portions by a vertical partition 21 so that the refrigerant flows upward through the four channels 3 at the right, downward through the subsequent eight refrigerant channels 3 and upward through the remaining nine refrigerant channels 3.

FIG. 8 shows the pair of plates 100 to be arranged at the positions corresponding to the communication tube portions 6 and flow-dividing communication tube portions 11. With reference to FIG. 8, one of the plates 100 is provided in the inner surface thereof with a tube recess 106 extending from front to rear to cause the front and rear two upper header recesses 102 to communicate with each other. The tube recess 106 of this plate 100 and an inner surface portion of the other plate 100 opposed thereto form the communication tube portion 6. The other plate 100 is provided in the inner surface thereof with a flow-dividing tube recess 111 extending from front to rear to cause the front and rear two lower header recesses 102 to communicate with each other. The flow-dividing tube recess 111 of the other plate 100 and an inner surface portion of the above-mentioned one plate 100 opposed thereto form the flow-dividing communication tube portion 11.

Figure 9:
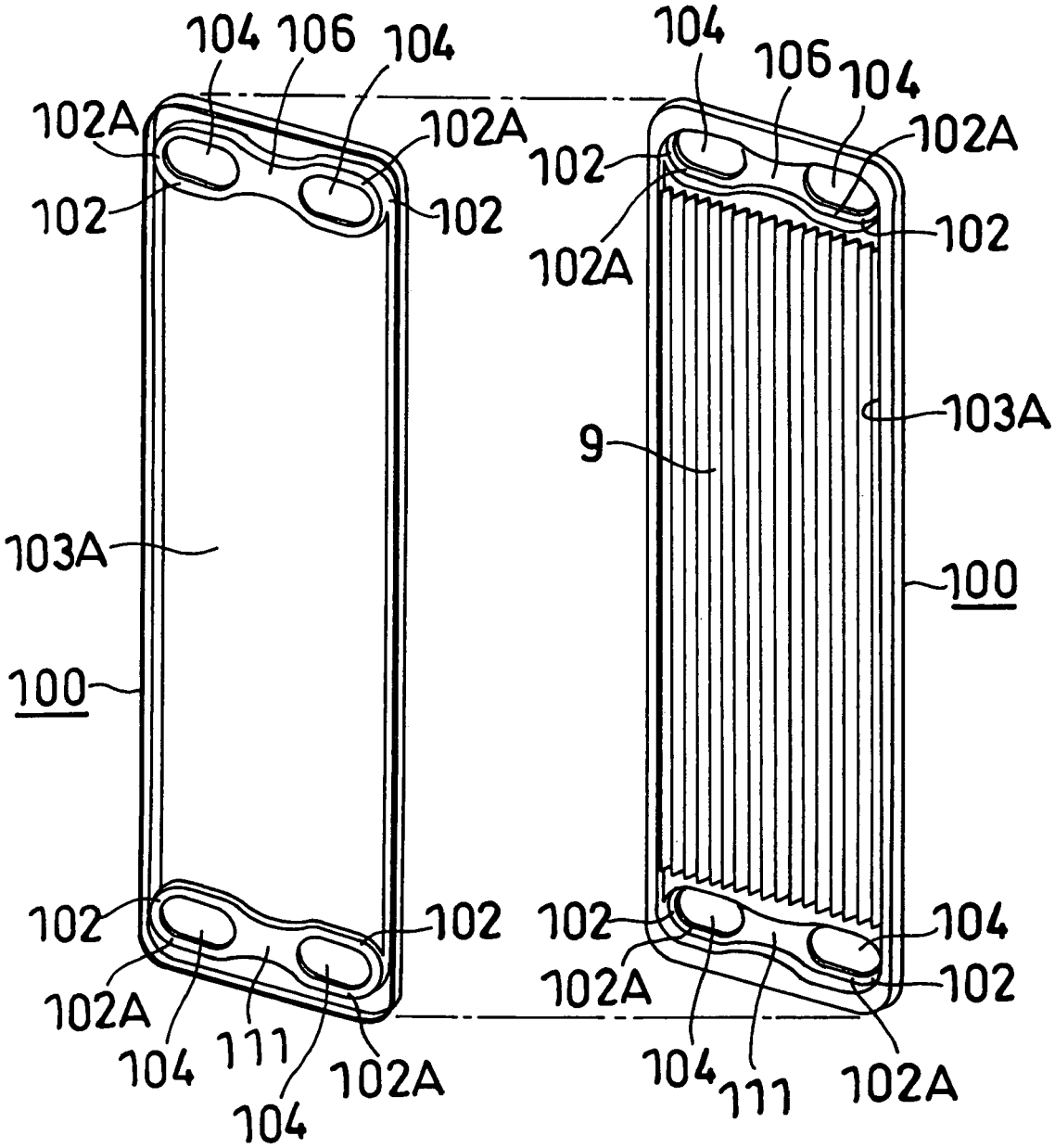
FIG. 9 is a perspective view of a third embodiment of the invention to show a pair of plates which are arranged at a position corresponding to a communication tube portion and flow-dividing communication tube portion.

FIG. 9 shows a third embodiment of the invention. This embodiment is the same as the second embodiment with the exception of the following. FIG. 9 shows a pair of plates 100 corresponding to those shown in FIG. 8 which shows the second embodiment, i.e., a pair of plates 100 to be positioned in corresponding relation with the communication tube portions 6 and flow-dividing communication tube portions 11. The front and rear two channel recesses 103 of each plate 100 of the pair are joined so as to communicate with each other over the entire length thereof. In other words, each of the pair of plates 100 is provided in its inner surface with a large channel recess 103A having a width approximate to the width of the plate 100 and serving as the front and rear two channel recesses. With the evaporator of this embodiment, the four refrigerant channels 3 of the rear heat exchange assembly 1B which provide an upward refrigerant channel group 3U at the right are each joined to the corresponding one of the four refrigerant channels 3 of the front heat exchange assembly 1A adjacent to these channels 3 to hold communication therebetween (see FIGS. 1 and 2). This construction further reduces the pressure loss of the refrigerant. The tube recess 106 and the flow-dividing tube recess 111 are formed in each of the plates 100. The inner fin 9 to be used has a width corresponding to the width of the recess 103A.

Figure 10:
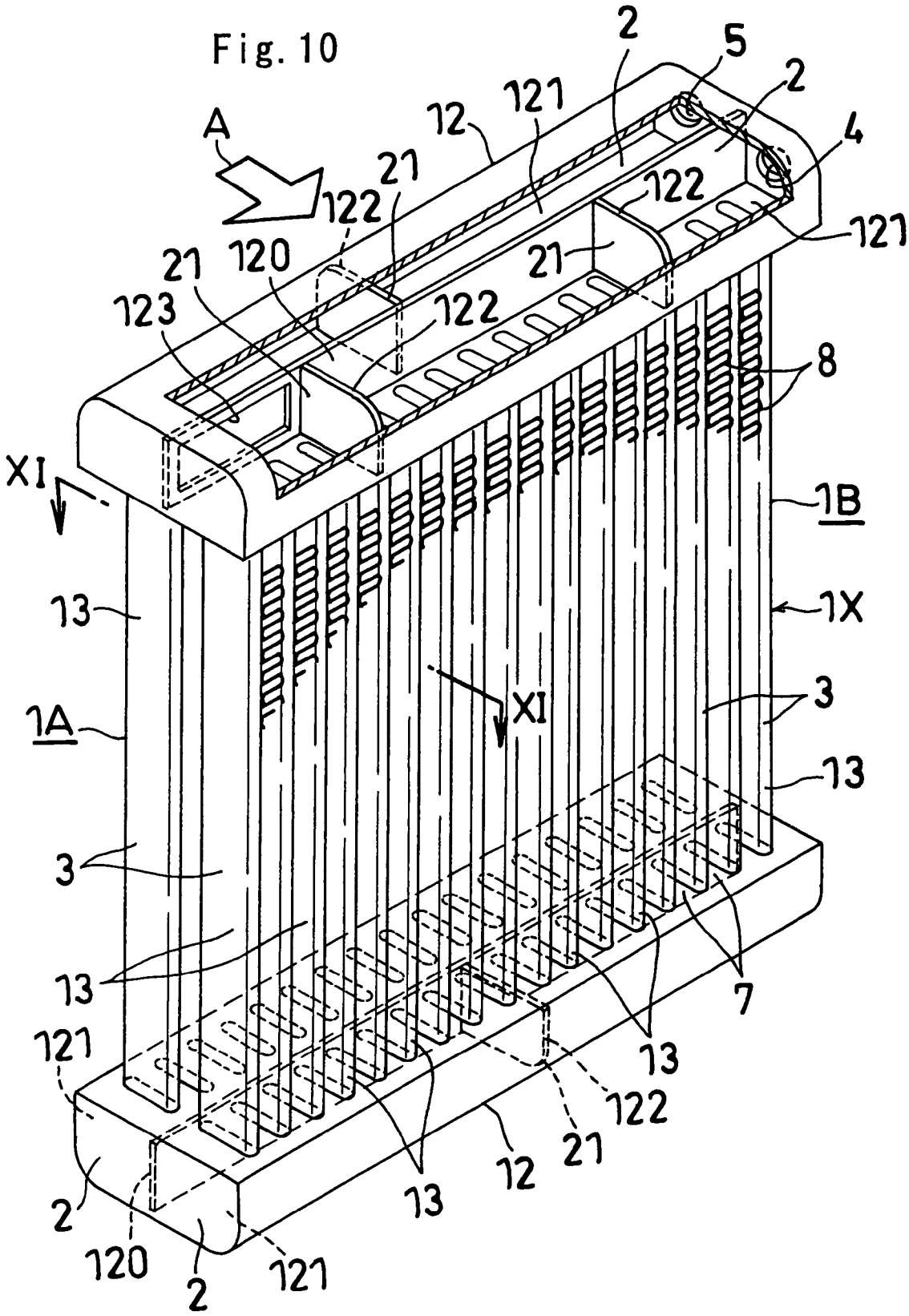
FIG. 10 is an overall perspective view showing a fourth embodiment of the invention, i.e., an evaporator for motor vehicle air conditioners.
Figure 11:
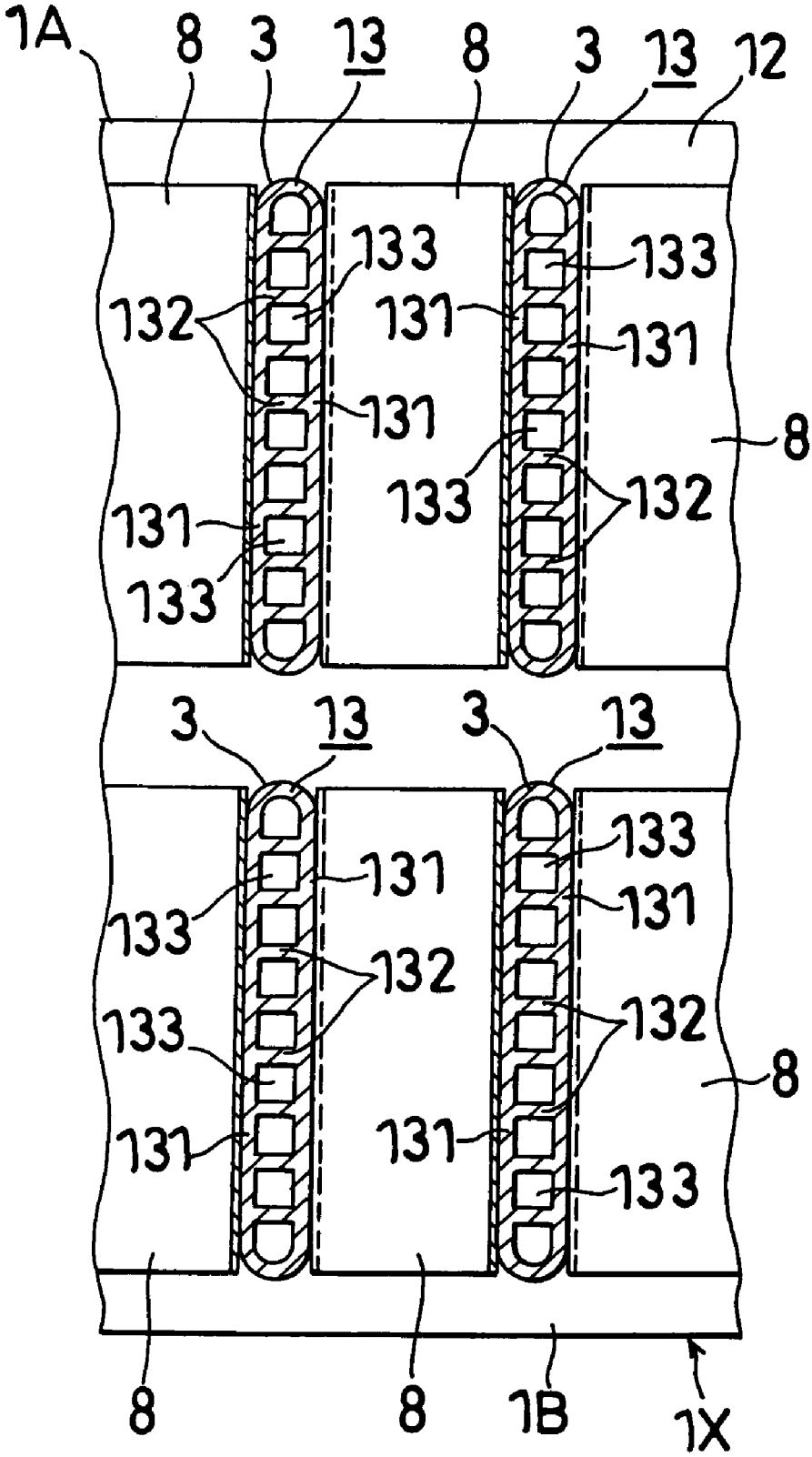
FIG. 11 is a fragmentary enlarged view in horizontal section taken along the line XI—XI in FIG. 10 and showing the evaporator.
Figure 12:
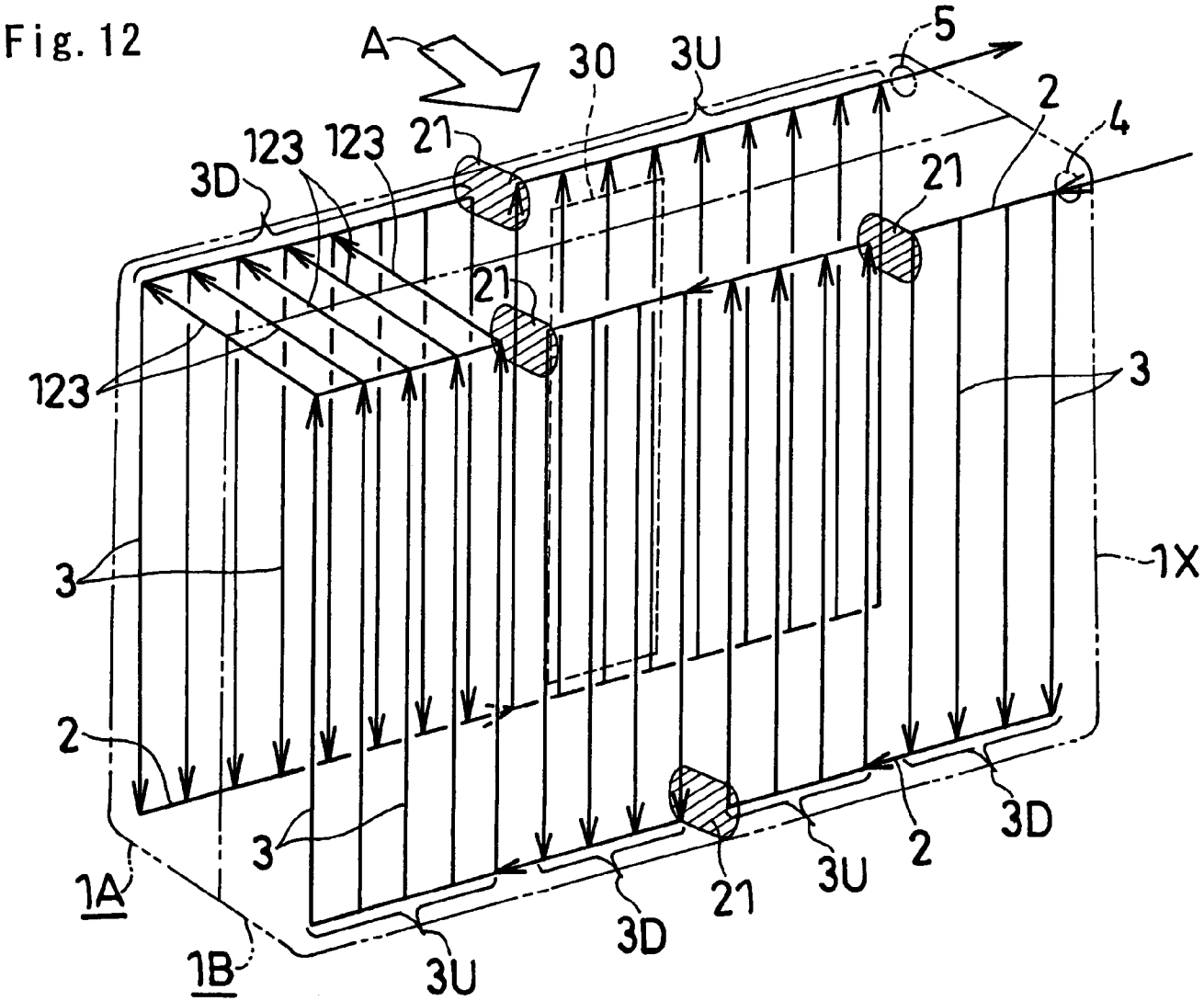
FIG. 12 is a diagram showing the flow of refrigerant through the evaporator of FIG. 10.

FIGS. 10 to 12 show a fourth embodiment of the invention. This embodiment is the same as the first embodiment with the exception of the following. With this embodiment, i.e., with an evaporator 1X, upper and lower headers 2 of front and rear heat exchange assemblies 1A, 1B are provided by front and rear two tank chambers 121 in a pair of upper and lower tanks 12 as shown in FIGS. 10 and 11. The front and rear heat exchange assemblies 1A, 1B have refrigerant channels 3 provided by front and rear two rows of many refrigerant vertical tubes 13 connected at the upper and lower ends thereof to the respective front and rear tank chambers 121 of the upper and lower tanks 12. The upper and lower headers 2 of the rear heat exchange assembly 1B have vertical partitions 21 provided by vertical walls 122 which are so arranged as to divide the rear tank chambers 121 of upper and lower tanks 12 into left and right portions. The upper header 2 of the front heat exchange assembly 1A has a vertical partition 21 provided by a vertical wall 122 which is so disposed as to divide the front tank chamber 121 of the upper tank 12 into left and right portions.

An outer fin 8 is interposed between each pair of laterally adjacent vertical tubes 13 and joined to the outer surfaces thereof. The tanks 12, vertical tubes 13 and outer fins 8 are all made of aluminum or aluminum alloy. These components are joined to one another usually by brazing.

The vertical tube 13 is flat and has a lateral width smaller than the front-to-rear width thereof. As shown in FIG. 11, the tube 13 has left and right walls 131 each having a planar outer surface, and a plurality of reinforcing walls 132 interconnecting the walls 131 and arranged forward or rearward as spaced apart from one another. A plurality of refrigerant passageways 133 arranged forward or rearward in parallel are formed in the interior of the vertical tube 13.

With reference to FIG. 10, the upper and lower tanks 12 are each divided into front and rear two tank chambers 121 by a vertical partition wall 120 extending leftward or rightward, i.e., laterally. The partition wall 120 of the upper tank 12 has a communication hole 123 (communication means) formed in a right end portion thereof for holding the front and rear tank chambers 121 in communication with each other at their right ends.

FIG. 12 shows the flow of refrigerant through the evaporator 1X described. The flow pattern is the same as that shown in FIG. 2. Stated more specifically, the refrigerant introduced into the evaporator 1X via the inlet 4 flows through the rear heat exchange assembly 1B via the upper and lower headers 2 of the assembly 1B, i.e., through the downward refrigerant channel group 3D at the left, the upward refrigerant channel group 3U at the left, the downward refrigerant channel group 3D at the right, and the upward refrigerant channel group 3U at the right in this order, then flows through the communication hole 123 into the front heat exchange assembly 1A, thereafter flows through the downward refrigerant channel group 3D at the right of the front assembly 1A and the upward refrigerant channel group 3U at the left thereof via the upper and lower headers 2 of the assembly 1A, and is discharged from the outlet 5.

Embodiments have been described above for illustrative purpose only. The present invention can of course be practiced as suitably modified without departing from the scope of the invention as set forth in the appended claims.

The invention claimed is:

1. An evaporator comprising:

a front heat exchange assembly and a rear heat exchange assembly arranged at an air inlet side and an air outlet side, respectively, and adjacent to each other, each of the heat exchange assemblies comprising a pair of upper and lower headers extending laterally;

a multiplicity of refrigerant channels arranged laterally at a spacing and each having an upper end connected to the upper header and a lower end connected to the lower header, a refrigerant inlet being provided at one end of the upper or lower header of the rear heat exchange assembly, a refrigerant outlet being provided at one end of the upper or lower header of the front heat exchange assembly, the upper or lower header of the rear heat exchange assembly communicating at a portion thereof toward the other end with the upper or lower header of the front heat exchange assembly at a portion thereof toward the other end by communication means; and the upper and lower headers of the rear heat exchange assembly being internally provided with vertical partitions for internally dividing the headers into portions arranged laterally so as to reverse the direction of upward or rearward flow of a refrigerant through the refrigerant channels of the rear heat exchange assembly for every specified number of refrigerant channels and thereby provide at least one group of upward refrigerant channels in each of a left half and a right half of the rear heat exchange assembly, wherein the upper and lower headers of the front and rear heat exchange assemblies are provided by front and rear two tank chambers in a pair of upper and lower tanks, and the refrigerant channels of the front and rear heat exchange assemblies are provided by front and rear two rows of plural refrigerant tubes connected at upper and lower ends thereof to the respective front and rear tank chambers of the upper and lower tanks, the partitions being formed by respective walls so provided as to divide the rear tank chambers of upper and lower tanks into portions arranged laterally, and the communication means is provided by a communication hole formed at the other end of a partition wall which internally divides the upper or lower tank into the front and rear two tank chambers.

2. An evaporator according to claim 1 wherein the refrigerant channels of the rear heat exchange assembly adjacent to the refrigerant channels of the front heat exchange assembly wherein the refrigerant is in an superheated state are included in the group of upward refrigerant channels.

3. An evaporator according to claim 1 wherein the refrigerant inlet is provided at one end of the lower header of the rear heat exchange assembly, and the rear heat exchange assembly has the group of upward refrigerant channels as each of the first and the third groups as counted from the refrigerant inlet side, and a group of downward refrigerant channels as each of the second and fourth groups as counted from the inlet side.

4. An evaporator according to claim 1 wherein the refrigerant inlet is provided at one end of the upper header of the rear heat exchange assembly, and the rear heat exchange assembly has the group of upward refrigerant channels as each of the second and the fourth groups as counted from the refrigerant inlet side, and a group of downward refrigerant channels as each of the first and third groups as counted from the inlet side.

5. An evaporator according to claim 1 wherein the refrigerant inlet is provided at one end of the lower header of the rear heat exchange assembly, and the rear heat exchange assembly has the group of upward refrigerant channels as each of the first and the third groups as counted from the refrigerant inlet side, and a group of downward refrigerant channels as the second group as counted from the inlet side.

6. An evaporator according to claim 1 wherein the rear heat exchange assembly has the group of upward refrigerant channels and a group of downward refrigerant channels each comprising four to eight refrigerant channels.

7. A vehicle provided with a refrigeration cycle having a compressor, a condenser and an evaporator, the evaporator being an evaporator according to claim 1.

8. A vehicle provided with a refrigeration cycle having a compressor, a condenser and an evaporator, the evaporator being an evaporator according to claim 2.

9. A vehicle provided with a refrigeration cycle having a compressor, a condenser and an evaporator, the evaporator being an evaporator according to claim 3.

10. A vehicle provided with a refrigeration cycle having a compressor, a condenser and an evaporator, the evaporator being an evaporator according to claim 4.

11. A vehicle provided with a refrigeration cycle having a compressor, a condenser and an evaporator, the evaporator being an evaporator according to claim 5.

12. A vehicle provided with a refrigeration cycle having a compressor, a condenser and an evaporator, the evaporator being an evaporator according to claim 6.

13. An evaporator comprising:

a front heat exchange assembly and a rear heat exchange assembly arranged at an air inlet side and an air outlet side, respectively, and adjacent to each other, each of the heat exchange assemblies comprising a pair of upper and lower chambers extending laterally;

an upper tank including the upper chambers of the front heat exchange assembly and the rear heat exchange assembly and an upper partition wall partitioning the upper chambers of the front heat exchange assembly and the rear heat exchange assembly;

a lower tank including the lower chambers of the front heat exchange assembly and the rear heat exchange assembly and a lower partition wall partitioning the lower chambers of the front heat exchange assembly and the rear heat exchange assembly;

a multiplicity of refrigerant channels arranged laterally at a spacing and each having an upper end connected to the upper chamber and a lower end connected to the lower chamber, a refrigerant inlet being provided at one end of the upper or lower chamber of the rear heat exchange assembly, a refrigerant outlet being provided at one end of the upper or lower chamber of the front heat exchange assembly, the upper or lower chamber of the rear heat exchange assembly communicating at the other end with the upper or lower chamber of the front heat exchange assembly at the other end by a communication hole formed at the other end of the partition wall of the upper or lower tank; and the upper and lower chambers of the rear heat exchange assembly being internally provided with vertical partitions for internally dividing the chambers into portions arranged laterally so as to reverse the direction of upward or rearward flow of a refrigerant through the refrigerant channels of the rear heat exchange assembly for every specified number of refrigerant channels and thereby provide at least one group of upward refrigerant channels in each of a left half and a right half of the rear heat exchange assembly.

14. An evaporator according to claim 13, wherein the refrigerant channels of the rear heat exchange assembly adjacent to the refrigerant channels of the front heat exchange assembly wherein the refrigerant is in an superheated state are included in the group of upward refrigerant channels.

15. An evaporator according to claim 13, wherein the refrigerant inlet is provided at one end of the lower chamber of the rear heat exchange assembly, and the rear heat exchange assembly has the group of upward refrigerant channels as each of the first and the third groups as counted from the refrigerant inlet side, and a group of downward refrigerant channels as each of the second and fourth groups as counted from the inlet side.

16. An evaporator according to claim 13, wherein the refrigerant inlet is provided at one end of the upper chamber of the rear heat exchange assembly, and the rear heat exchange assembly has the group of upward refrigerant channels as each of the second and the fourth groups as counted from the refrigerant inlet side, and a group of downward refrigerant channels as each of the first and third groups as counted from the inlet side.

17. An evaporator according to claim 13, wherein the refrigerant inlet is provided at one end of the lower chamber of the rear heat exchange assembly, and the rear heat exchange assembly has the group of upward refrigerant channels as each of the first and the third groups as counted from the refrigerant inlet side, and a group of downward refrigerant channels as the second group as counted from the inlet side.

18. An evaporator according to claim 13, wherein the rear heat exchange assembly has the group of upward refrigerant channels and a group of downward refrigerant channels each comprising four to eight refrigerant channels.

* * * * *